US012127675B2

(12) United States Patent
Case et al.

(10) Patent No.: US 12,127,675 B2
(45) Date of Patent: Oct. 29, 2024

(54) SMART GAMING CHAIR

(71) Applicant: Ace Bayou Corp., Kenner, LA (US)

(72) Inventors: Gareth Case, Bradford (GB); Robert McNae, Kenner, LA (US)

(73) Assignee: Ace Bayou Corp., Kenner, LA (US)

( * ) Notice: Subject to any disclaimer, the term of this patent is extended or adjusted under 35 U.S.C. 154(b) by 83 days.

(21) Appl. No.: 17/941,724

(22) Filed: Sep. 9, 2022

(65) Prior Publication Data

US 2023/0079380 A1 Mar. 16, 2023

Related U.S. Application Data

(60) Provisional application No. 63/242,528, filed on Sep. 10, 2021.

(51) Int. Cl.

| | |
|---|---|
| ***A47C 1/00*** | (2006.01) |
| ***A47C 7/72*** | (2006.01) |
| ***A47C 7/74*** | (2006.01) |

(52) U.S. Cl.

CPC ..... *A47C 1/00* (2013.01); *A47C 7/725* (2013.01); *A47C 7/727* (2018.08); *A47C 7/74* (2013.01)

(58) Field of Classification Search

CPC ..... A47C 7/727; A47C 7/725; A47C 7/74; A47C 1/00

USPC ..... 297/195.11

See application file for complete search history.

(56) References Cited

U.S. PATENT DOCUMENTS

| | | | | |
|---|---|---|---|---|
| 4,607,882 | A * | 8/1986 | Opsvik | A47C 9/002 297/195.11 |
| 7,399,034 | B2 * | 7/2008 | Fullmer | A47D 1/00 297/217.3 |
| 8,816,873 | B2 * | 8/2014 | Bisset | A61H 19/30 601/84 |
| 2004/0242306 | A1 | 12/2004 | Tarantino | |
| 2009/0206641 | A1 * | 8/2009 | Brown, Jr. | A47C 7/723 297/217.3 |
| 2009/0270157 | A1 | 10/2009 | Christensen | |
| 2018/0325262 | A1 | 11/2018 | Richardson | |
| 2019/0293278 | A1 | 9/2019 | McNae | |

FOREIGN PATENT DOCUMENTS

| | | | |
|---|---|---|---|
| CN | 106274562 | A * | 1/2017 |
| EP | 3033972 | A1 * | 6/2016 |
| JP | 2001120630 | A * | 5/2001 |
| KR | 101196065 | B1 * | 11/2012 |

OTHER PUBLICATIONS

International Search Report and Written Opinion Received for PCT/US2022/43091 on Dec. 15, 2022, 10 pgs.

* cited by examiner

*Primary Examiner* — Milton Nelson, Jr.

(74) *Attorney, Agent, or Firm* — Spencer Fane LLP

(57) ABSTRACT

A smart gaming chair system for use in conjunction with a video gaming system. The smart gaming chair system includes a gaming chair and a body presence sensor. The gaming chair includes at least one of a speaker, a vibration mechanism and a light. The gaming chair is operably connected to a video game system. The body presence sensor is mounted with respect to gaming chair. The body presence sensor is capable of sensing a person in the gaming chair and in response to the sensing of the person in the gaming chair, controlling operation of the at least one of the speaker, the vibration mechanism and the light.

18 Claims, 3 Drawing Sheets

SMART GAMING CHAIR

REFERENCE TO RELATED APPLICATION

This application claims priority to Provisional Applic. No. 63/242,528, filed on Sep. 10, 2021, the contents of which are incorporated herein by reference.

FIELD OF THE INVENTION

The invention relates generally to gaming chairs. More particularly, the invention relates to a smart gaming chair.

BACKGROUND OF THE INVENTION

Chairs made specifically for gaming have become a major commodity in the gaming community in recent years. Many gaming chairs include speakers and a control panel that facilitates connection of the gaming chair to a gaming system and which enable the sound emitted by the speakers to be adjusted.

Pressure sensor technology has been used in a variety of ways over the years, most notably in a wheelchair. In such applications, the pressure sensor technology alerts medical professionals that a person has moved from a position seated in the wheelchair.

SUMMARY OF THE INVENTION

An embodiment of the invention is directed to a smart gaming chair system for use in conjunction with a video gaming system. The smart gaming chair system includes a gaming chair and a body presence sensor. The gaming chair includes at least one of a speaker, a vibration mechanism and a light. The gaming chair is operably connected to a video game system. The body presence sensor is mounted with respect to gaming chair. The body presence sensor is capable of sensing a person in the gaming chair and in response to the sensing of the person in the gaming chair, controlling operation of the at least one of the speaker, the vibration mechanism and the light.

Another embodiment of the invention is directed to a smart gaming chair system for use in conjunction with a video gaming system. The smart gaming chair system includes a gaming chair, a body presence sensor, a temperature sensor, a temperature change mechanism and a body excitement monitor. The gaming chair includes at least one of a speaker, a vibration mechanism and a light. The gaming chair is operably connected to a video game system. The body presence sensor is mounted with respect to gaming chair. The body presence sensor is capable of sensing a person in the gaming chair and in response to the sensing of the person in the gaming chair, controlling operation of the at least one of the speaker, the vibration mechanism and the light. The body presence sensor is at least one of a pressure sensor and a motion sensor. The temperature sensor is mounted with respect to the gaming chair. The temperature sensor is capable of sensing a body temperature of the person in the gaming chair. The temperature change mechanism is capable of at least one of cooling and heating the person sitting in the gaming chair. The temperature change mechanism is operably connected to the temperature sensor. The temperature change mechanism is mounted with respect to the gaming chair. The body excitement monitor is mounted with respect to the gaming chair. The body excitement monitor is capable of sensing an excitement level of the person sitting in the gaming chair and in response to the sensed excitement level, controlling the operation of the at least one of the speaker, the vibration mechanism and the light and wherein the body excitement monitor comprises at least one of a heart rate sensor, a respiration rate sensor and a blood oxygen concentration sensor.

Another embodiment of the invention is directed to a method of using a smart gaming chair system in conjunction with a video gaming system. A gaming chair is provided that includes at least one of a speaker, a vibration mechanism and a light. The gaming chair is operably connected to a video gaming system. A person is sensed in the gaming chair with a body presence sensor mounted with respect to gaming chair. In response to the sensing of the person in the gaming chair, operation of the at least one of the speaker, the vibration mechanism and the light is controlled.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
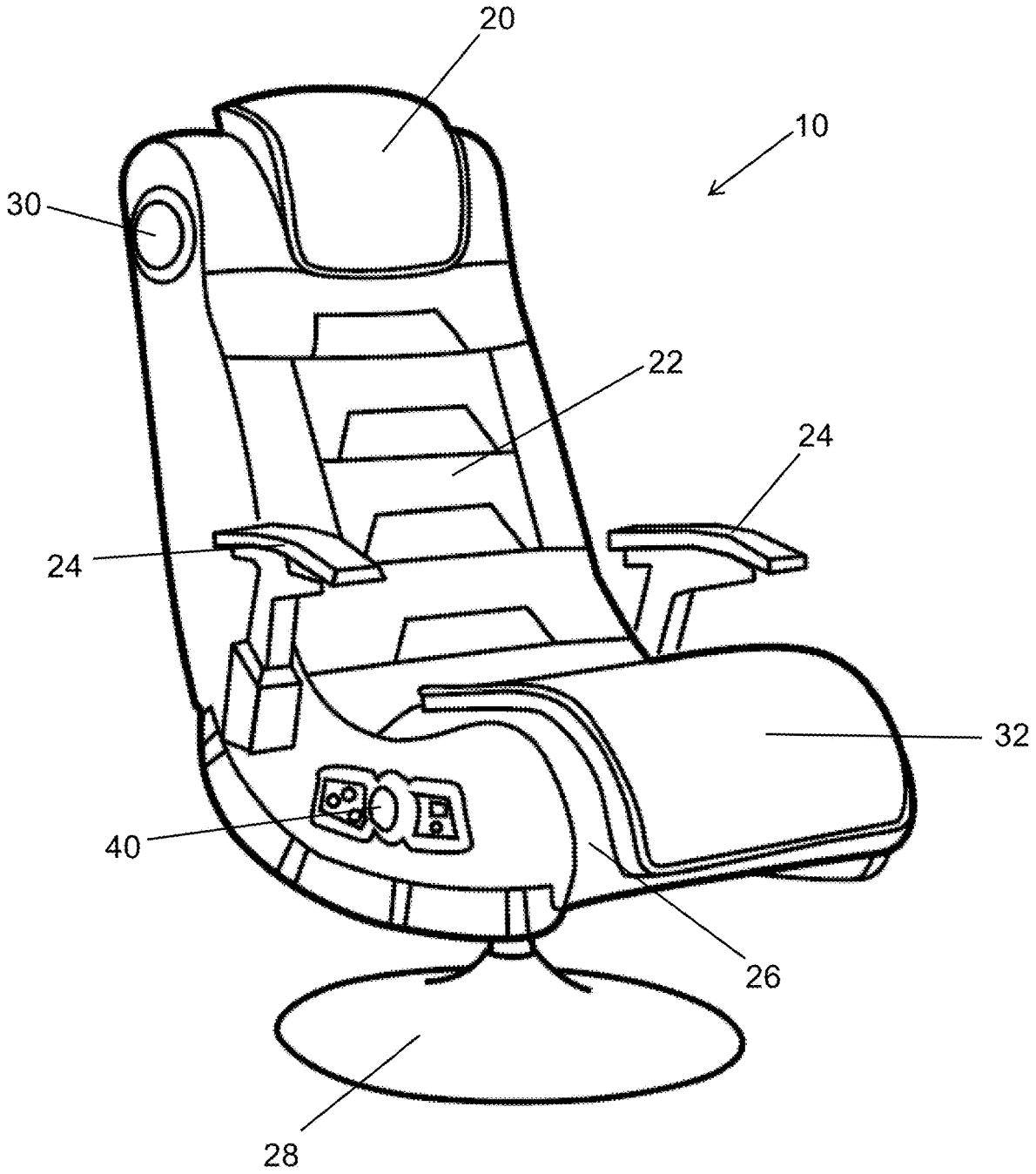
FIG. 1 is a perspective view of a smart gaming chair according to an embodiment of the invention.

An embodiment of the invention is directed to a smart gaming chair, which is illustrated at 10 in FIG. 1. The smart gaming chair 10 may assume a variety of configurations using the concepts of the invention.

In certain embodiments, the smart gaming chair 10 generally includes a back portion 22 that is mounted with respect to a seat portion 26. The back portion 22 and the seat portion 26 support a person seated on the smart gaming chair 10. A person of skill in the art will appreciate that the concepts of the invention may be adapted for use in conjunction with other types of gaming furniture.

The smart gaming chair 10 may include a chair base 28 that supports the smart gaming chair 10 at a desired height above a surface on which the smart gaming chair 10 is placed. In certain embodiments, the chair base 28 includes a plurality of wheels to facilitate moving the smart gaming chair 10 with respect to the surface on which the smart gaming chair 10 is placed.

The smart gaming chair 10 may also include a headrest 20, at least one armrest 24 and at least one speaker 30. The headrest 20 is mounted with respect to the back portion 22 to provide additional support to a head of the person seated on the smart gaming chair 10. The headrest 20 thereby enhances comfort of the person who is seated on the smart gaming chair 10.

In certain embodiments, the at least one armrest 24 is mounted with respect to the seat portion 26 so that the at least one armrest 24 can support arms of the person seated on the smart gaming chair 10. The at least one armrest 24 thereby enhances comfort of the person who is seated on the smart gaming chair 10.

The at least one speaker 30 may be provided in a variety of locations on or in the smart gaming chair 10. In certain embodiments, the at least one speaker 30 is mounted proximate an upper end of the back portion 22 so that the at least one speaker 30 is proximate to ears of the person seated on the smart gaming chair 10.

The smart gaming chair 10 includes a body presence sensor 32 that is capable of sensing the presence of the person in the smart gaming chair. In certain embodiments, the body presence sensor 32 is a pressure sensor mounted with respect to the seat portion 26 such that weight of the person sitting on the seat portion 26 activates the body presence sensor 32. It is also possible for the body presence sensor 32 to be mounted to at least one of the back portion 22 and the armrest 24.

While the body presence sensor 32 is illustrated as being mounted on an upper surface of the seat portion 26, it is possible for the body presence sensor 32 to be mounted in an interior of the seat portion 26. It is also possible for the body presence sensor 32 to be mounted with respect to the back portion 22. In still other embodiments, the body presence sensor 32 may be mounted to at least one of the headrest 20 and the armrest 24.

In other embodiments, the body presence sensor 32 is a motion sensor. As the person sits in the smart gaming chair 10, the process of the person contacting the smart gaming chair 10 causes the smart gaming chair 10 to move and such movement activates the body presence sensor 32. Even when the person is not intending to move while seated in the smart gaming chair 10, the person causes the smart gaming chair 10 to move and such movement is identified as the person being seated in the smart gaming chair 10.

The smart gaming chair 10 may also include a control panel 40. In certain embodiments, the control panel 40 is provided on a side of the seat portion 26. Mounting the control panel 40 in this location enables the control panel 40 to be readily accessed when the person is seated in the smart gaming chair 10 while not interfering with the person's use of the smart gaming chair 10.

The control panel 40 enables the person to control the operation of the smart gaming chair 10. For example, the control panel 40 may include a power switch to turn on and off the components in the smart gaming chair 10. The control panel 40 may also include a volume adjustment to change a level at which sound is emitted from the at least one speaker 30. The control panel 40 may also include the ability to adjust additional aspects of the sound such as a bass level and a vibration level.

Additionally, the control panel 40 may include a power connector that attaches the smart gaming chair 10 to an external power source. The power connector may directly deliver power to the components of the smart gaming chair 10. Alternatively, the power connector may be used to charge a battery in the smart gaming chair 10.

Figure 3:
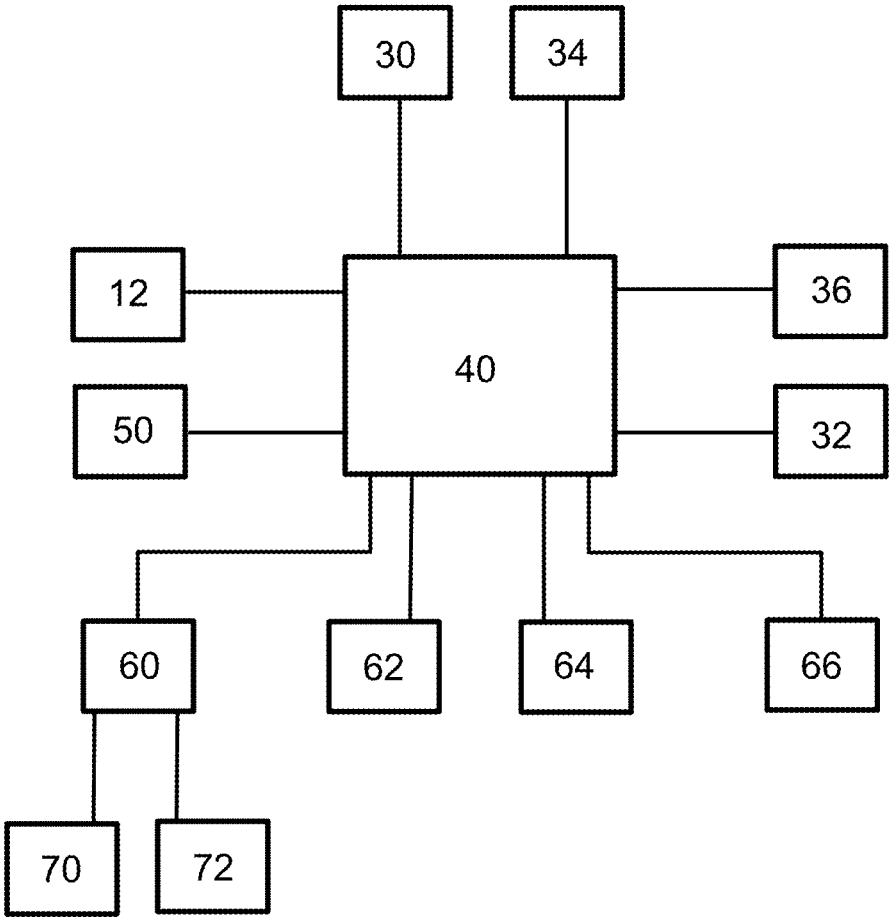
FIG. 3 is a schematic diagram of sensors in the smart gaming chair.

The control panel 40 may also be used to connect the smart gaming chair 10 to a gaming system 12. The connection of the components in the smart gaming chair 10 is schematically illustrated in FIG. 3. In certain embodiments, the connection between the smart gaming chair 10 and the gaming system 12 is wireless such as using Bluetooth or Wi-Fi. The connection between the smart gaming chair 10 and the gaming system 12 may alternatively use a wired connection.

Figure 2:
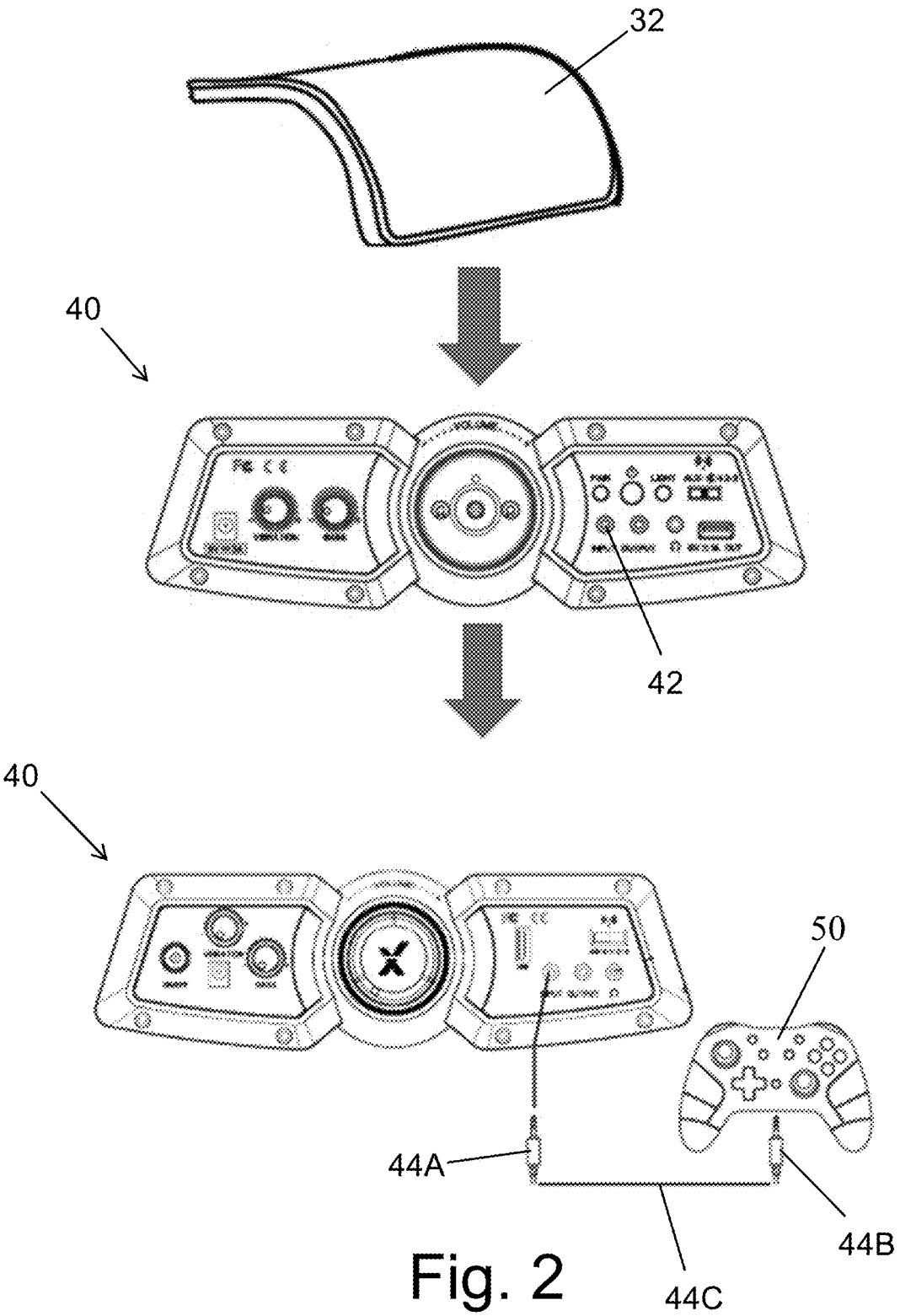
FIG. 2 illustrates use of the smart gaming chair.

The control panel 40 may include an input port 42 as illustrated in FIG. 2. The input port 42 allows a first end 44A of an auxiliary cord 44C to be inserted into the input port 42. A second input 44B of the auxiliary cord 44C is inserted in the gaming controller 50 to thereby operably connect the smart gaming chair 10 and the gaming controller 50. In another embodiment, the gaming controller 50 wirelessly connects with the smart gaming chair 10 such as using Bluetooth and/or Wi-Fi.

The input port 42 thereby allows for features within the gaming controller 50 to be portrayed within the smart gaming chair 10. For example, when the person is playing a first person shooter game and the person gets shot from the left side in the video game, rather than just feeling the vibration on the left side of the gaming controller 50, the person will feel the vibration on the left side of the smart gaming chair 10. The vibrations may be produced by a vibration mechanism 34 that is mounted with respect to the smart gaming chair 10.

When the gaming controller 50 is connected to the control panel 40, the at least one speaker 30 may work in unison, or individually depending on the situation within the video game the person is playing. For example, while playing a sports video game, the person may hear the crowd chanting out of both speakers in unison. In another example, if the person is playing a first-person shooter video game, the person will hear a gun shot that originates on your right from only the right speaker 30. It is also possible for the invention to be utilized in conjunction with other devices that are capable of emitting sounds.

The control panel 40 may include a port that enables gaming headphones (not shown) to be used in conjunction with the smart gaming chair 10. The gaming headphones may include speakers and a microphone.

The smart gaming chair 10 may also include at least one light 36 that is mounted with respect to the smart gaming chair 10 such that the at least one light 36 may be illuminated while using the smart gaming chair 10. The at least one light 36 may be illuminated in response to aspects of the video game being played using the gaming system 12.

When engaged by the person while sitting in the smart gaming chair 10, the body presence sensor 32 may automatically activate the smart gaming chair 10. Likewise, when the person no longer engages the body presence sensor 32, the smart gaming chair 10 may automatically turn off. This feature allows for the person to preserve energy by means of a battery pack or standard wall plug-in without the person needing to remember to turn the smart gaming chair 10 on and off.

In another embodiment, when the body presence sensor 32 is engaged, the smart gaming chair 10 will connect with the gaming system 12 to notify friends that the person sitting in the smart gaming chair 10 has begun a gaming session. This feature will allow for additional connectivity with peers of similar interest.

In yet another embodiment, when the body presence sensor 32 disengages and the video game remains on, the control panel 40 may communicate with the gaming system 12 to activate a recording feature many gaming systems offer. When the body presence sensor 32 is reengaged by the person sitting in the smart gaming chair 10, the person may be provided with the ability to review what happened in the video game while the person was not seated in the smart gaming chair 10.

The smart gaming chair 10 may include additional sensors to enhance the gaming experience. For example, the smart gaming chair 10 includes at least one temperature sensor 60 that is capable of sensing the temperature of the person sitting in the smart gaming chair 10.

The temperature sensor 60 is located on a portion of the smart gaming chair 10 that will be proximate the body of the person sitting in the smart gaming chair 10. In certain embodiments, the temperature sensor 60 may be located on or in at least one of the seat portion 26, the back portion 22 and the armrests 24.

Depending on the mechanism that is used by the temperature sensor 60 to measure the temperature of the person sitting in the smart gaming chair 10, the person's body may need to be directly in contact with the temperature sensor 60. Alternatively, the temperature sensor 60 may measure the temperature when the person's body is in proximity to the temperature sensor 60.

The sensed temperature of the person sitting in the smart gaming chair 10 may be used for a variety of purposes using the concepts of the invention. In one such embodiment, the smart gaming chair 10 may include cooling functionality 70 that is activated if the sensed temperature of the person sitting in the smart gaming chair 10 is greater than a threshold level. The threshold temperature level for activating the cooling functionality 70 may be statically set at a particular level. Alternatively, the person sitting in the smart gaming chair 10 may be able to adjust the temperature at which the cooing functionality 70 is activated. A switch may be provided to turn on/off the cooling functionality 70.

The cooling functionality 70 may be implemented using a variety of techniques. One exemplary technique for implementing the cooling functionality 70 is a cooling pad that is mounted on or near a surface of at least one of the seat portion 26, the back portion 22 and the armrests 24. Another exemplary technique for implementing the cooling functionality is using a cooling element and a fan mounted inside the smart gaming chair 10. After the cooling element cools air, the fan causes cooled air to move through an upper surface of at least one of the seat portion 26, the back portion 22 and the armrests 24 such as using a plurality of apertures in the upper surface of at least one of the seat portion 26, the back portion 22 and the armrests.

Alternatively or additionally, the smart gaming chair 10 may include heating functionality 72 that is activated if the sensed temperature of the person sitting in the smart gaming chair 10 is lower than a threshold level. The threshold temperature level for activating the heating functionality 72 may be statically set at a particular level. Alternatively, the person sitting in the smart gaming chair 10 may be able to adjust the temperature at which the heating functionality 72 is activated. A switch may be provided to turn on/off the heating functionality 72.

The heating functionality 72 may be implemented using a variety of techniques. One exemplary technique for implementing the heating functionality 72 is a heating pad that is mounted on or near a surface of at least one of the seat portion 26, the back portion 22 and the armrests 24. Another exemplary technique for implementing the heating functionality 72 is using a heating element and a fan mounted inside the smart gaming chair 10. After the heating element heats air, the fan causes the heated air to move through an upper surface of at least one of the seat portion 26, the back portion 22 and the armrests 24 such as using a plurality of apertures in the upper surface of at least one of the seat portion 26, the back portion 22 and the armrests 24.

As an alternative to automatically activating the cooling functionality 70 or the heating functionality 72, the smart gaming chair 10 smart gaming chair may notify the person sitting in the smart gaming chair 10 of the person's body temperature being above or below the threshold level and ask the person sitting in the smart gaming chair 10 if it is desired for the cooling functionality 70 or the heating functionality 72 to be activated.

In certain embodiments, the person sitting in the smart gaming chair 10 may cause the cooling functionality 70 or the heating functionality 72 to be activated using a verbal command. Alternatively or additionally, the person sitting in the smart gaming chair 10 may activate the cooling functionality 70 or the heating functionality 72 by touching a physical switch such as on the control panel 40 or on the gaming controller 50.

In other embodiments, the smart gaming chair 10 includes body excitement monitor that is capable of sensing an excitement level of the person sitting in the smart gaming chair 10 and then controlling the operation of certain aspects of the smart gaming chair such as the speaker 30, the vibration mechanism 34 and the light 36.

In one such embodiment, the body excitement monitor is a heart rate sensor 62 that is capable of measuring the heart rate of the person sitting in the smart gaming chair 10. If the sensed heart rate is not within a specified range, the smart gaming chair 10 may notify the person sitting in the smart gaming chair 10.

Alternatively or additionally, certain features of the smart gaming chair may be modified in response to the measured heart rate. For example, a rate at which vibrations are emitted by the smart gaming chair 10 may change based upon the measured heart rate.

Alternatively or additionally, the rate at which lights are illuminated and/or the change of color in which the lights are illuminated may be modified based upon the measured heart rate.

In certain configurations, the vibration rate and/or light illumination rate may be directly related to the measured heart rate. This configuration may encourage the person sitting in the smart gaming chair 10 to get more into the action of the video game being played.

In other configurations, the vibration rate and/or light illumination rate may be inversely related to the measured heart rate. This configuration may encourage the person sitting in the smart gaming chair 10 to remain calm during parts of the video game that are particularly intense.

The heart rate sensor 62 is located on or in a portion of the smart gaming chair 10 that will be proximate the body of the person sitting in the smart gaming chair 10. In certain embodiments, the heart rate sensor 62 may be located on or in at least one of the seat portion 26, the back portion 22 and the armrests 24.

In still other embodiments, the body excitement monitor a respiration rate sensor 64 to measure the respiration rate at which the person sitting in the smart gaming chair 10. If the sensed respirate rate is not within a specified range, the smart gaming chair 10 may notify the person sitting in the smart gaming chair 10.

Alternatively or additionally, certain features of the smart gaming chair may be modified in response to the measured respiration rate. For example, a rate at which vibrations are emitted by the smart gaming chair 10 may change based upon the measured respiration rate.

Alternatively or additionally, the rate at which lights are illuminated and/or the change of color in which the lights are illuminated may be modified based upon the measured respiration rate.

In certain configurations, the vibration rate and/or light illumination rate may be directly related to the measured respiration rate. This configuration may encourage the person sitting in the smart gaming chair 10 to get more into the action of the video game being played.

In other configurations, the vibration rate and/or light illumination rate may be inversely related to the measured respiration rate. This configuration may encourage the person sitting in the smart gaming chair 10 to remain calm during parts of the video game that are particularly intense.

The respiration rate sensor 64 is located on or in a portion of the smart gaming chair 10 that will be proximate the body of the person sitting in the smart gaming chair 10. In certain embodiments, the respiration rate sensor 64 may be located on or in at least one of the seat portion 26, the back portion 22 and the armrests 24.

In yet another configuration, the smart gaming chair 10 includes an oxygen concentration sensor 66 that is capable of measuring the blood oxygen concentration of the person sitting in the smart gaming chair 10. If the blood oxygen concentration is not within a specified range, the smart gaming chair 10 may notify the person sitting in the smart gaming chair 10.

The oxygen concentration sensor 66 is located on or in a portion of the smart gaming chair 10 that will be proximate the body of the person sitting in the smart gaming chair 10. In certain embodiments, the oxygen concentration sensor 66 may be located on or in at least one of the seat portion 26, the back portion 22 and the armrests 24.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A smart gaming chair system for use in conjunction with a video gaming system, wherein the smart gaming chair system comprises:

a gaming chair comprising at least one of a speaker, a vibration mechanism and a light, wherein the gaming chair is operably connected to a video game system; and a body presence sensor mounted with respect to gaming chair, wherein the body presence sensor comprises a motion sensor and a pressure sensor, wherein the motion sensor is capable of sensing movement of the gaming chair resulting from a person contacting the gaming chair and in response to the sensing movement of the gaming chair, controlling operation of the at least one of the speaker, the vibration mechanism and the light.

2. The smart gaming chair system of claim 1, wherein the body presence sensor causes the gaming chair to turn on in response to sensing the movement of the gaming chair and wherein the body presence sensor causes the gaming chair to turn off in response to not sensing movement of the gaming chair.

3. The smart gaming chair system of claim 1, and further comprising:

a temperature sensor mounted with respect to the gaming chair, wherein the temperature sensor is capable of sensing a body temperature of the person in the gaming chair; and a temperature change mechanism that is capable of at least one of cooling and heating the person in the gaming chair, wherein the temperature change mechanism is operably connected to the temperature sensor and wherein the temperature change mechanism is mounted with respect to the gaming chair.

4. The smart gaming chair system of claim 1, and further comprising a control panel mounted to the gaming chair, wherein the body presence sensor and the at least one of the speaker, the vibration mechanism and the light are operably connected to the control panel.

5. The smart gaming chair system of claim 1, wherein the gaming chair comprises a back portion, a seat portion and an armrest, wherein the back portion is mounted with respect to the seat portion and wherein the armrest is mounted with respect to at least one of the seat portion and the back portion.

6. The smart gaming chair system of claim 1, and further comprising a body excitement monitor mounted with respect to the gaming chair, wherein the body excitement monitor is capable of sensing an excitement level of the person in the gaming chair and in response to the sensed excitement level, controlling the operation of the at least one of the speaker, the vibration mechanism and the light.

7. The smart gaming chair system of claim 6, wherein the body excitement monitor comprises at least one of a heart rate sensor, a respiration rate sensor and a blood oxygen concentration sensor.

8. A method of using a smart gaming chair system in conjunction with a video gaming system, wherein the method comprises:

providing a gaming chair comprising at least one of a speaker, a vibration mechanism, a light and a body presence sensor, wherein the gaming chair is operably connected to a video gaming system;

sensing movement of the gaming chair resulting from a person contacting the gaming chair, wherein the movement is sensed using a motion sensor that is part of the body presence sensor;

activating recording of a video game in response to not sensing movement of the gaming chair; and in response to sensing movement of the gaming chair, offering the person the ability to watch the recording of the video game.

9. A smart gaming chair system for use in conjunction with a video gaming system, wherein the smart gaming chair system comprises:

a gaming chair comprising at least one of a speaker, a vibration mechanism and a light, wherein the gaming chair is operably connected to a video game system;

a body presence sensor mounted with respect to gaming chair, wherein the body presence sensor comprises a motion sensor and wherein the motion sensor is capable of sensing movement of the gaming chair and in response to the sensing movement of the gaming chair resulting from a person contacting the gaming chair, controlling operation of the at least one of the speaker, the vibration mechanism and the light;

a temperature sensor mounted with respect to the gaming chair, wherein the temperature sensor is capable of sensing a body temperature of the person in the gaming chair;

a temperature change mechanism that is capable of at least one of cooling and heating the person sitting in the gaming chair, wherein the temperature change mechanism is operably connected to the temperature sensor and wherein the temperature change mechanism is mounted with respect to the gaming chair; and a body excitement monitor mounted with respect to the gaming chair, wherein the body excitement monitor is capable of sensing an excitement level of the person sitting in the gaming chair and in response to the sensed excitement level, controlling the operation of the at least one of the speaker, the vibration mechanism and the light and wherein the body excitement monitor comprises at least one of a heart rate sensor, a respiration rate sensor and a blood oxygen concentration sensor, wherein the body presence sensor causes the gaming chair to turn on in response to sensing the movement of the gaming chair and wherein the body presence sensor causes the gaming chair to turn off in response to not sensing movement of the gaming chair.

10. The smart gaming chair system of claim 9, and further comprising a control panel mounted to the gaming chair, wherein the body presence sensor and the at least one of the speaker, the vibration mechanism and the light are operably connected to the control panel, wherein the gaming chair comprises a back portion, a seat portion and an armrest, wherein the back portion is mounted with respect to the seat portion and wherein the armrest is mounted with respect to at least one of the seat portion and the back portion.

11. A method of using a smart gaming chair system in conjunction with a video gaming system, wherein the method comprises:

providing a gaming chair comprising at least one of a speaker, a vibration mechanism, a light and a body presence sensor, wherein the gaming chair is operably connected to a video gaming system;

sensing movement of the gaming chair resulting from a person contacting the gaming chair, wherein the movement is sensed using a motion sensor that is part of the body presence sensor;

turning on the gaming chair in response to sensing movement of the gaming chair; and turning off the gaming chair in response to not sensing movement of the gaming chair.

12. A method of using a smart gaming chair system in conjunction with a video gaming system, wherein the method comprises:

providing a gaming chair comprising at least one of a speaker, a vibration mechanism, a light and a body presence sensor, wherein the gaming chair is operably connected to a video gaming system;

sensing movement of the gaming chair resulting from a person contacting the gaming chair, wherein the movement is sensed using a motion sensor that is part of the body presence sensor;

pausing a video game in response to not sensing movement of the gaming chair; and resuming the video game in response to sensing movement of the gaming chair.

13. The method of claim 11, wherein the sensing the person in the chair gaming further comprises sensing a weight of the person in the gaming chair.

14. The method of claim 11, and further comprising:

sensing a body temperature of the person in the gaming chair with a temperature sensor mounted with respect to the gaming chair; and based upon the sensed body temperature, cooling or heating the person in the gaming chair with a temperature change mechanism, wherein the temperature change mechanism is mounted with respect to the gaming chair.

15. The method of claim 11, and further comprising:

sensing an excitement level of the person in the gaming chair with a body excitement monitor mounted with respect to the gaming chair; and in response to the sensed excitement level, controlling the operation of the at least one of the speaker, the vibration mechanism and the light.

16. The method of claim 15, wherein the sensing the excitement level comprises at least one of measuring a heart rate of the person, measuring a respiration rate of the person and measuring a blood oxygen concentration of the person.

17. The method of claim 15, wherein a change in the operation of the at least one of the speaker, the vibration mechanism and the light is directly related to the sensed excitement level of the person.

18. The method of claim 11, and further comprising sending a notification to the video gaming system in response to sensing movement of the gaming chair.

* * * * *